US005641275A

United States Patent [19]

Klein et al.

[11] Patent Number: 5,641,275

[45] Date of Patent: Jun. 24, 1997

[54] GROOVED SHAFT FOR A MAGNETIC-DRIVE CENTRIFUGAL PUMP

[75] Inventors: Manfred P. Klein, Highland Park; Jeff S. Brown, Palitine, both of Ill.

[73] Assignee: Ansimag Inc., Elk Grove Village, Ill.

[21] Appl. No.: 378,774

[22] Filed: Jan. 26, 1995

[51] Int. Cl.[6] ..... F04B 17/00; F04B 53/18

[52] U.S. Cl. ..... 417/420; 417/370; 415/176

[58] Field of Search ..... 417/420, 366, 417/368, 369, 370; 415/115, 176

[56] References Cited

U.S. PATENT DOCUMENTS

| | | | |
|---|---|---|---|
| 2,120,914 | 6/1938 | Vogel | 417/368 |
| 2,830,541 | 4/1958 | Higgins et al. | 417/370 |
| 4,013,384 | 3/1977 | Oikawa | 415/115 |
| 4,047,847 | 9/1977 | Oikawa . | |
| 4,710,111 | 12/1987 | Kubo . | |
| 5,184,945 | 2/1993 | Chi-Wei | 417/420 |
| 5,248,245 | 9/1993 | Behnke et al. . | |
| 5,269,664 | 12/1993 | Buse . | |
| 5,320,431 | 6/1994 | Kallenberger . | |
| 5,320,432 | 6/1994 | Fox . | |
| 5,464,333 | 11/1995 | Okada et al. | 417/420 |

FOREIGN PATENT DOCUMENTS

| | | | |
|---|---|---|---|
| 123711 | 9/1979 | Japan | 417/368 |

*Primary Examiner*—Timothy Thorpe
*Assistant Examiner*—Roland G. McAndrews, Jr.
*Attorney, Agent, or Firm*—Darin E. Bartholomew

[57] ABSTRACT

The grooved shaft for a magnetic-drive centrifugal pump preferably has an axial groove with a semi-elliptical or U-shaped groove cross section. Adjoining the axial groove is a flat area which is tapered tangentially relative to a substantially cylindrical shaft area. The grooved shaft optimally has a front shaft radius and a rear shaft radius, wherein the front shaft radius is smaller than the rear shaft radius such that the front shaft radius may be oriented near an impeller intake to decrease hydraulic flow resistance. Meanwhile, the rear shaft radius provides increased axial and radial load capacity for the grooved shaft. In practice, the grooved shaft is incorporated into a magnetic-drive centrifugal pump and the groove is statically oriented in a position of minimal radial loading. In the centrifugal pump, the grooved shaft forms an immobile channel for the internal circulation of pumped fluid about the product-lubricated wearing surfaces so the grooved shaft and an associated bearing are amply lubricated or cooled.

35 Claims, 12 Drawing Sheets

FIG. 2 (PRIOR ART.)

GROOVED SHAFT FOR A MAGNETIC-DRIVE CENTRIFUGAL PUMP

TECHNICAL FIELD

The present invention relates generally to a centrifugal pump, and more particularly, to a grooved shaft for a magnetic-drive centrifugal pump and a magnetic-drive centrifugal pump incorporating the grooved shaft.

BACKGROUND ART

Magnetic-drive centrifugal pumps may be classified as synchronous or nonsynchronous. Synchronous pumps generally use magnetic coupling between a first magnetic cylinder and a second magnetic cylinder, which are separated by a containment shell. The first magnetic cylinder is coaxially oriented with respect to the second magnetic cylinder. Nonsynchronous drive centrifugal pumps use eddy current coupling between a magnetic cylinder and a torque ring, which is typically made of steel and copper. For nonsynchronous magnetic-drive pumps, the magnetic cylinder is coaxially oriented with respect to the torque ring.

Background art magnetic-drive centrifugal pumps frequently use journal or sleeve-type bearings in conjunction with a pump shaft. For optimum operation, sleeve-type bearings require the formation of a thin lubricating film between the shaft and the bearing surfaces. Whether or not the requisite lubricating film is formed between the shaft and the bearing surfaces may depend upon the viscosity of the lubricant, the rotational speed of the surfaces, and the load pressure applied to the surfaces.

There are two basic lubrication operating regimes for the shaft and bearing surfaces: (1) a hydrodynamic film lubrication regime, in which wear of the surfaces is minimal or nonexistent, and (2) a mixed film lubrication regime, in which wear of the surfaces occurs. In the hydrodynamic film lubrication regime a thin lubricating film is present and prevents the shaft journal from directly contacting the bearing surface. On the other hand, in the mixed film lubrication regime a journal is partially supported by a thin lubricating film and partially supported by direct rubbing contact between the wearing surfaces.

Background art journal bearings and sleeve-type bearings may have axial, curved, helical, or spiral grooves to improve distribution of the lubricant on bearing and shaft surfaces. However, a groove in a journal bearing invariably results in increased wear of an associated shaft journal or decreased radial loading capacity of an associated shaft. A grooved bearing has less surface area for supporting a given radial load than a conventional bearing without a groove. Therefore, a grooved bearing typically operates in the mixed film lubrication regime. If, for example, a grooved journal bearing is used in conjunction with a stationary shaft, than the groove in the journal bearing rotates in alignment with the radial load force vector upon each revolution of the bearing. In general, when the groove is in alignment with the radial load force vector, then the shaft and the bearing surfaces operate in the mixed film lubrication regime. Hence, the mixed film lubrication causes the shaft or bearing surfaces to wear and may damage the shaft or bearing surfaces. Spiral or curved grooves, in the cylindrical interior surfaces of journal bearings, are difficult to machine when the bearings are constructed from hardened metals or ceramics.

Magnetic-drive centrifugal pumps typically use sleeve-type or journal bearings that are lubricated by the pumped fluid. For example, FIG. 1 discloses a prior art bearing 10 and a prior art shaft 24, which are product-lubricated. The prior art shaft 24 has a substantially cylindrical shaft surface 28 with an optional threaded segment 32 for affixing the shaft 24 to a vaned rotor. The prior art shaft 24 also has a head 26 to facilitate attachment to a rotatable magnetic cylinder or a torque ring. The prior art bearing 10 includes a sleeve 14 with a cylindrical inner surface 16. The cylindrical inner surface 16 comprises an appropriate product lubricated wearing surface. The prior art bearing 10 has bypass holes 20 axially extending through the bearing 10. In addition, a face of the bearing 10 preferably has radial notches 18.

FIG. 2 illustrates the prior art bearing 10 and the prior art shaft 24 incorporated into a magnetic-drive centrifugal pump wherein the prior art shaft 24 is rotatable. The prior art bearing 10 is secured to the casing 54 by bearing holder 50. The prior art shaft 24 is affixed to the vaned rotor 36 and is secured by a shaft nut 34. The prior art shaft 24 is also attached to a torque ring 44. The vaned rotor 36 is bounded by a front wear ring 38 and rear wear ring 40. Similarly, the prior art bearing 10 is bounded by a front thrust washer 46 and a rear thrust washer 48. A containment barrier 42 is secured to the casing 54. The casing 54 has an internal channel 52 extending from the periphery of the rotor 36 to the torque ring 44.

While the majority of the fluid is conveyed from the casing inlet 56 to the casing outlet 58, a minority of the fluid is circulated via the channel 52 of the pump to provide lubrication and cooling of the prior art shaft 24 and the prior art bearing 10. A main fluid flow path 60, and a internal circulation path, which includes a bushing flow path 62 and a bypass flow path 64 are shown in FIG. 2 as dotted lines with arrows indicating the direction of flow. The main fluid flow path 60 extends from the casing inlet 56 to the casing outlet 58. The internal circulation path starts near the rotor's discharge at a starting point 68. From the starting point 68 the internal circulation fluid path contacts the wearing surfaces of the bearing 10 and the shaft 24 via the bushing flow path 62. The internal circulation path includes the bypass flow path 64 through the bypass holes 20. Finally, the internal circulation path ends near the eye of the vaned rotor 36 at a termination point 72. The internal circulation occurs because of the pressure-velocity differential between the starting point 68 and the termination point 72. Specifically, the starting point 68 is near the high pressure of the casing outlet 58 and the termination point 72 is near the suction of the vaned rotor 36.

In the prior art pump shown in FIG. 2, the bypass holes 20 may pass liquid while gases and vapor accumulate at the interface between the bearing 10 and the shaft 24. Therefore, the product-lubricated wearing surfaces of the bearing 10 and shaft 24 are exposed to intervals of diminished lubrication because of the presence of the vapor component of the pumped fluid. The selective and problematic routing of vapor and gases to the wearing surfaces is caused by the centrifugal action fluid near the bearing 10.

In general, another problem in background art centrifugal pumps is that particulate matter, or solid particles, in the pumped fluid become trapped in the space between the bearing surface and the pump shaft. Trapped particles may scratch or score either the bearing or the shaft surfaces causing premature bearing or bearing failure. Some particles may even adhere to the shaft or bearing surfaces; especially after the shaft surfaces have been scratched or scored. Moreover, trapped particles lodged in the internal circulation path may further impede the cooling of the shaft. Cooling may be impeded because of increased hydraulic resistance of the congested bushing flow path. In addition, thermal problems may arise from particles adhering to bearing or shaft surfaces and preventing pumped fluid (i.e. lubricant) from contacting these surfaces.

Thus, a need exists for an improved shaft for a magnetic-drive centrifugal pump. In particular, a need exists for a shaft which reduces or ameliorates thermal problems and shaft scoring associated with trapped particles at the pump shaft-bearing interface. Moreover, a need exists for a shaft and bearing combination having increased longevity compared to prior art shaft and bearing combinations.

SUMMARY OF THE PRESENT INVENTION

The grooved shaft for a magnetic-drive centrifugal pump preferably has an axial groove with a semi-elliptical or U-shaped groove cross section. Adjoining the axial groove is a flat area which is tapered tangentially to a substantially cylindrical area. The grooved shaft optimally has a front shaft radius and a rear shaft radius, wherein the front shaft radius is smaller than the rear shaft radius to decrease hydraulic flow resistance near or at an impeller intake. Meanwhile, the rear shaft radius provides increased axial and radial load capacity. The grooved shaft is preferably constructed from a ceramic compound, such as silicon carbide.

In practice, the grooved shaft is incorporated into a magnetic-drive centrifugal pump such that the shaft is stationary and a bearing rotates about the shaft. The grooved shaft forms a channel for the internal circulation of pumped fluid about the product-lubricated wearing surfaces so the grooved shaft and an associated bearing are amply lubricated and so that particulate matter in the pumped fluid has a reliable, immobile channel for bypassing the wearing surfaces. The grooved shaft allows the bearing and the shaft surfaces to establish a lubricating film more quickly upon initial start-up of the pump than was previously established by background art pumps having grooved journal bearings. The axial groove provides particulate matter, which exceeds the size of the clearance between the grooved shaft and bearing, a viable escape route from the clearance between the grooved shaft and the bearing to the outlet of the pump. In addition, the grooved shaft has a shaft cross section which is contoured to remove particles from the shaft-bearing interface.

The grooved shaft is preferably positioned to minimize loading on the axial groove. Strategically orienting the grooved shaft within the centrifugal pump improves the longevity of the bearing and the grooved shaft by decreasing the possibility that the bearing and shaft are operating in the mixed film lubrication regime. The grooved shaft may have a flat mating surface which engages a corresponding socket in a shaft support assembly for appropriate positioning of the shaft.

The centrifugal pump optimally has a nonmetallic containment shell and a shaft support assembly with ribs to complement the lubrication and cooling functions of the grooved shaft. The nonmetallic containment shell prevents heating of the pumped fluid by eddy currents; the ribs are positioned near the rear of the impeller and direct pumped fluid through the axial groove.

DESCRIPTION OF THE DRAWINGS

FIG. 8 shows the preferred stationary orientation of the grooved shaft, with respect to the housing.

FIG. 9 depicts the shaft having a first groove and a second groove.

DETAILED DESCRIPTION

The centrifugal pump of the present invention includes various embodiments of notched shafts or grooved shafts to improve cooling, lubrication, or particulate bypass of the shaft-bearing interface. The combination of a grooved shaft and a corresponding bearing may be sold as an upgrade kit for field modification of existing centrifugal pumps. In addition, the grooved shaft may be incorporated into a new magnetic-drive centrifugal pump or a centrifugal pump having a product lubricated bearing. Features such as non-metallic containment shells and ribbed interior pump structures may further complement the cooling and lubrication functions of the grooved shaft.

Grooved Shaft

Figure 1:
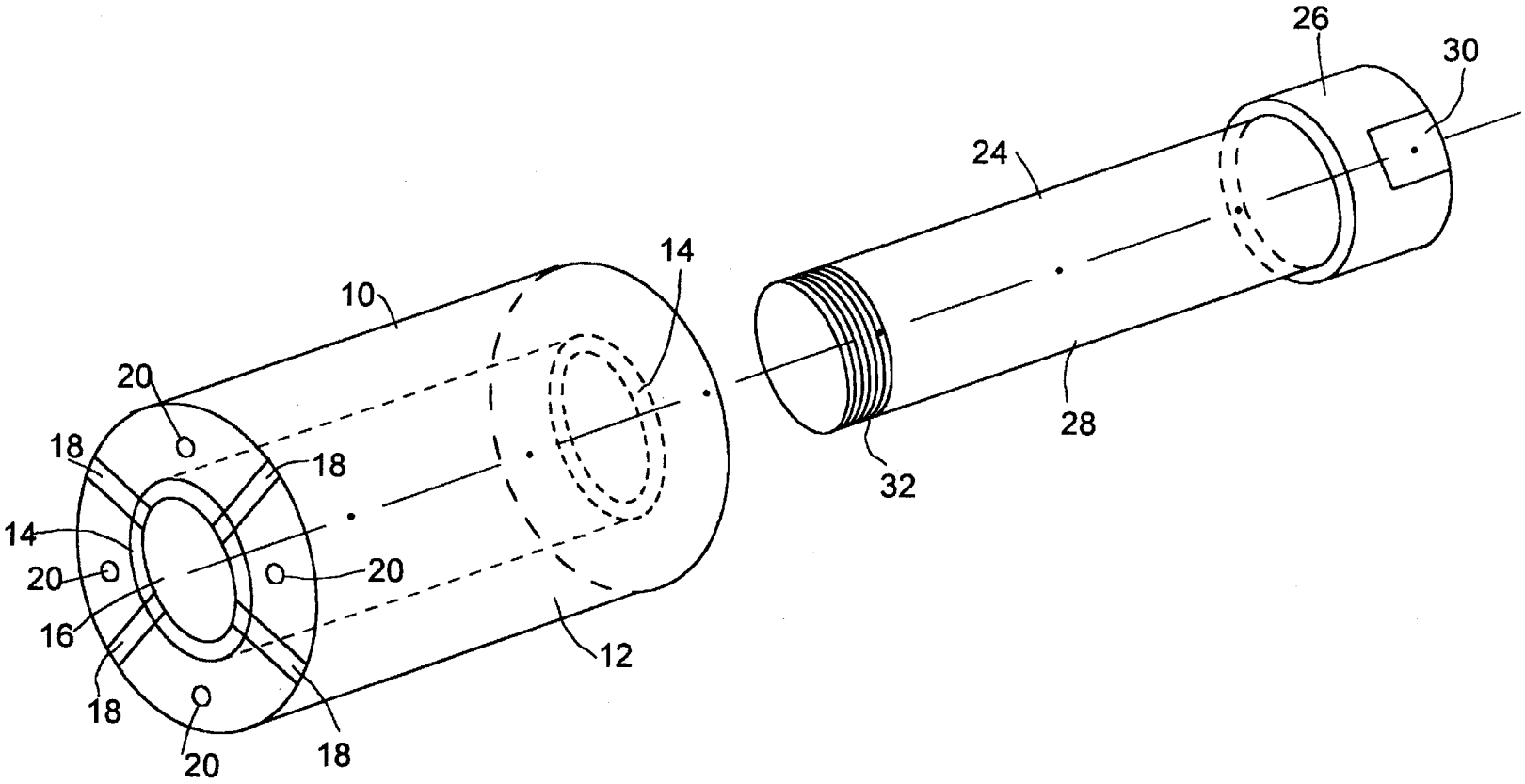
FIG. 1 (PRIOR ART)
FIG. 1 shows an exploded perspective view of a prior art shaft and a prior art bearing having axial bypass holes.
Figure 2:
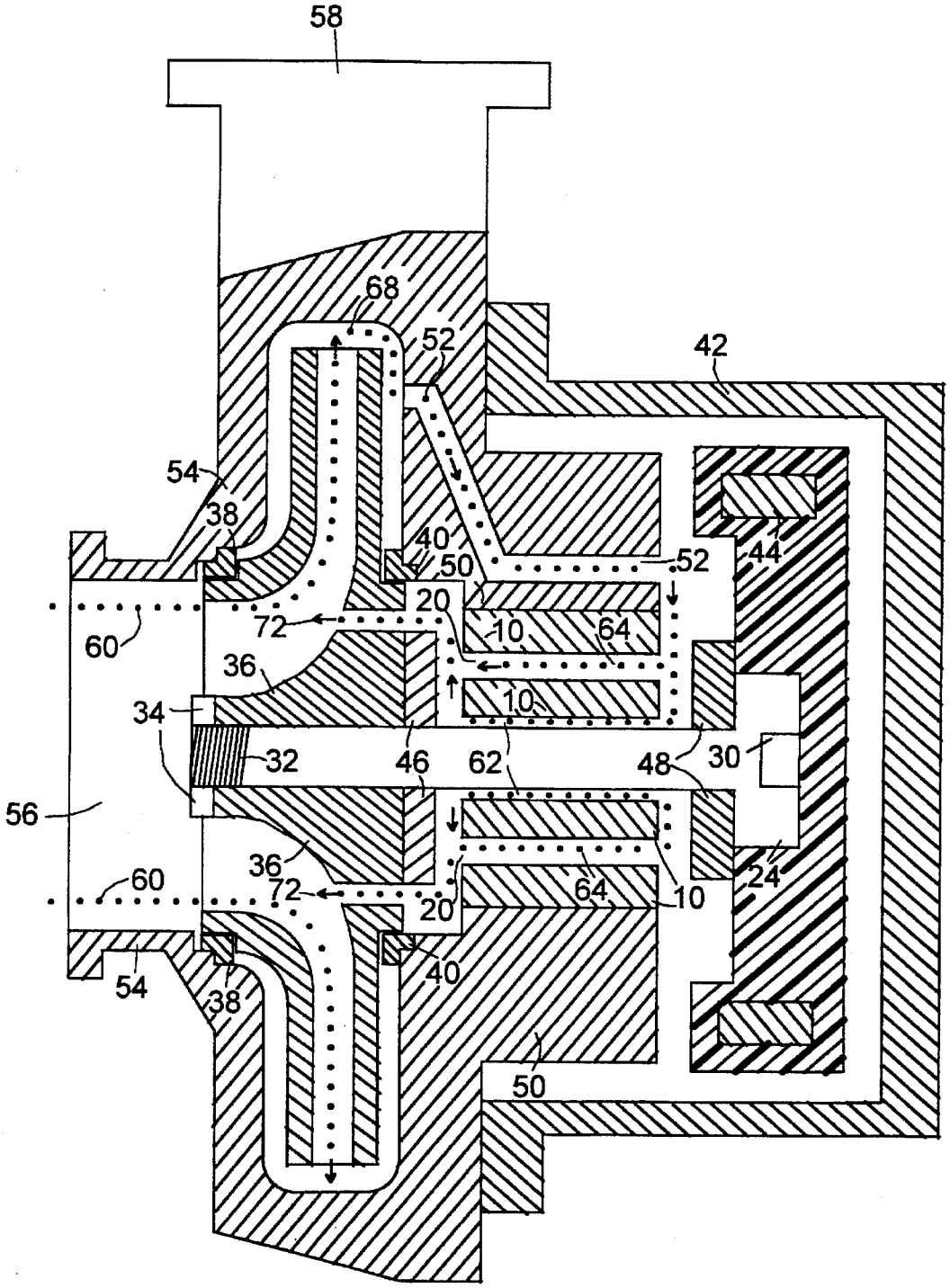
FIG. 2 shows a cross-sectional view of a centrifugal pump incorporating the prior art shaft and the prior art bearing of FIG. 1.
Figure 3:
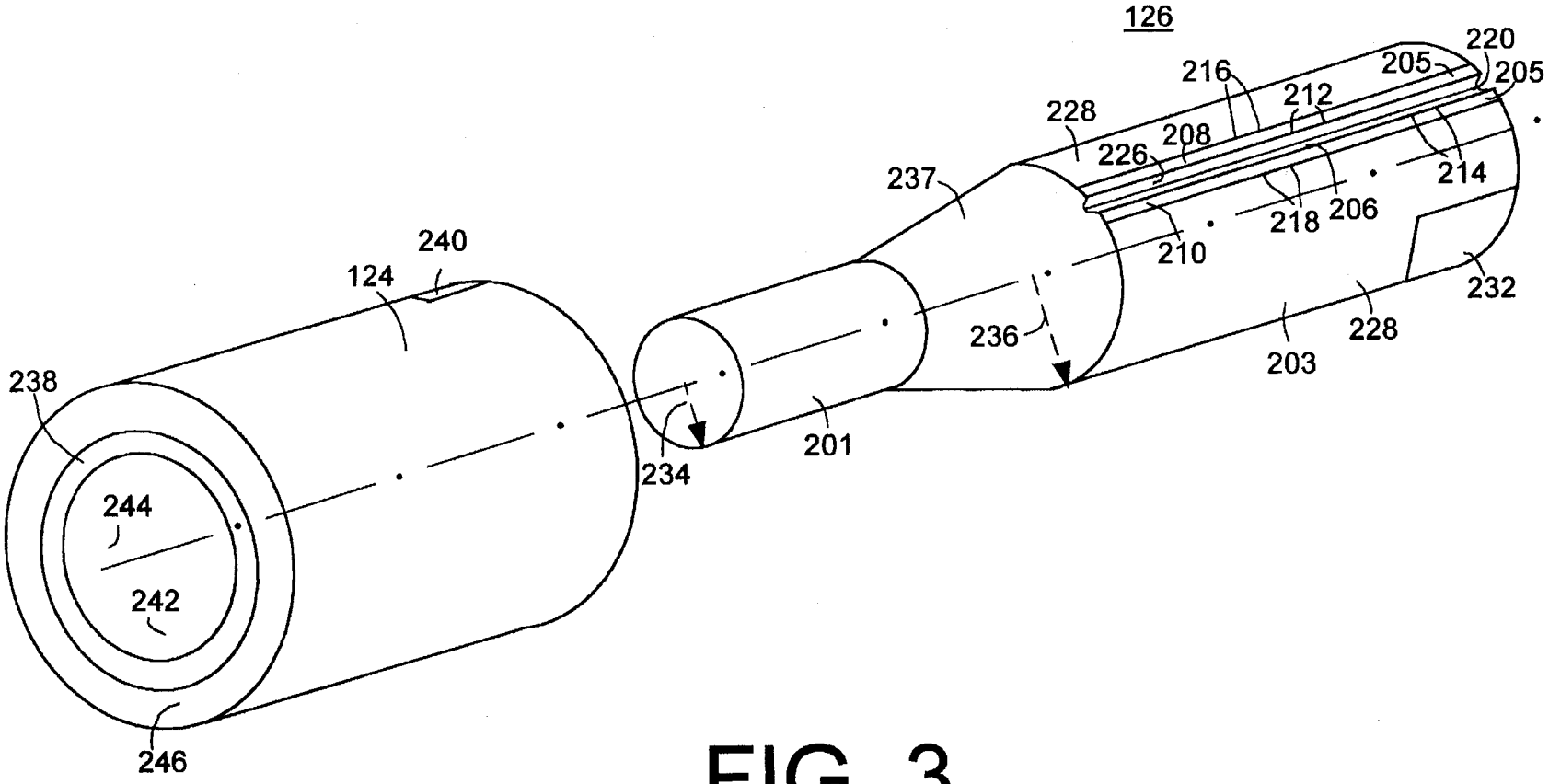
FIG. 3 shows an exploded perspective view of one embodiment of the grooved shaft and its associated bearing.
Figure 4:
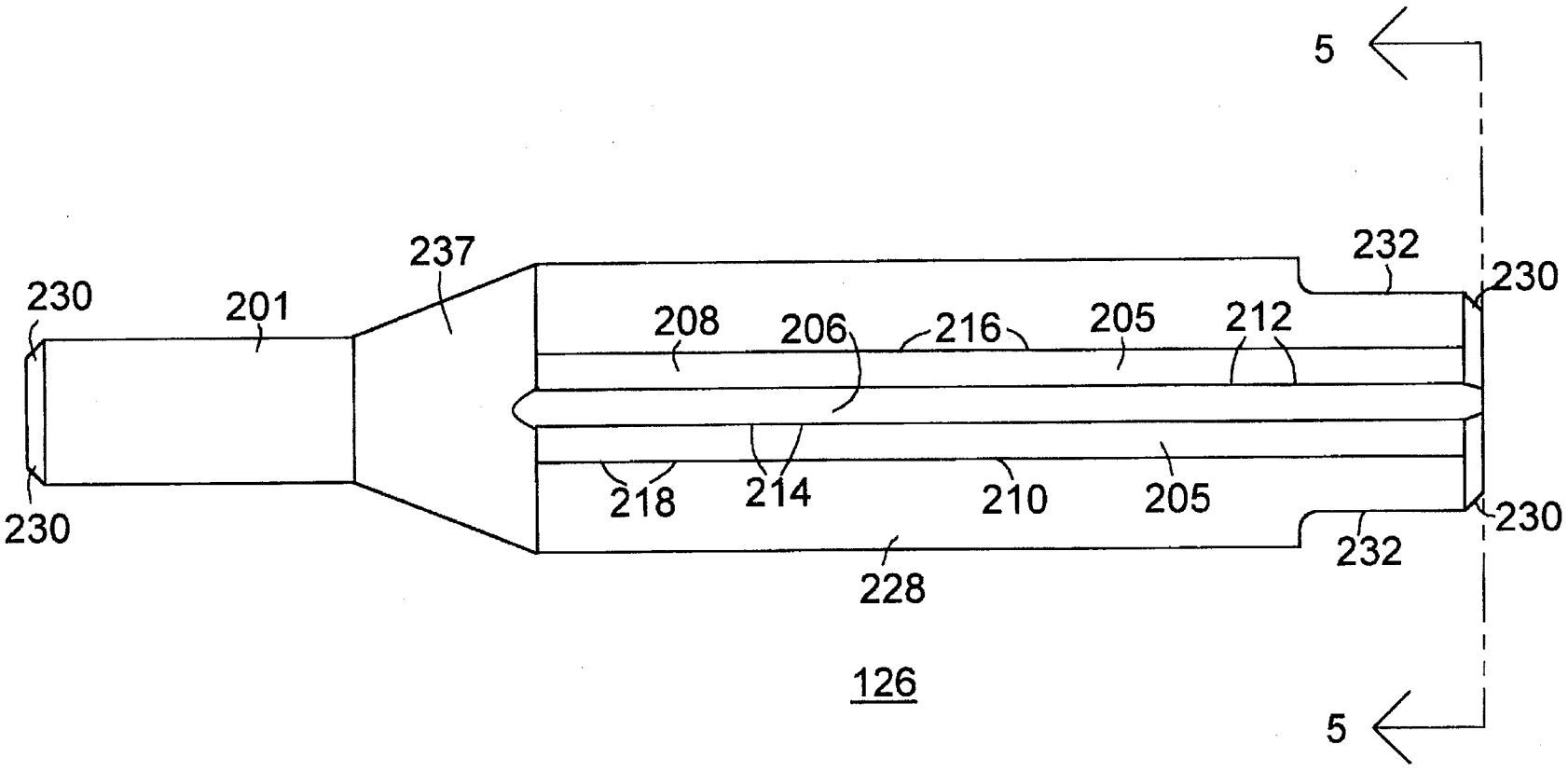
FIG. 4 shows an elevation view of the grooved shaft of FIG. 3 in which the grooved shaft has chamfered edges.
Figure 5:
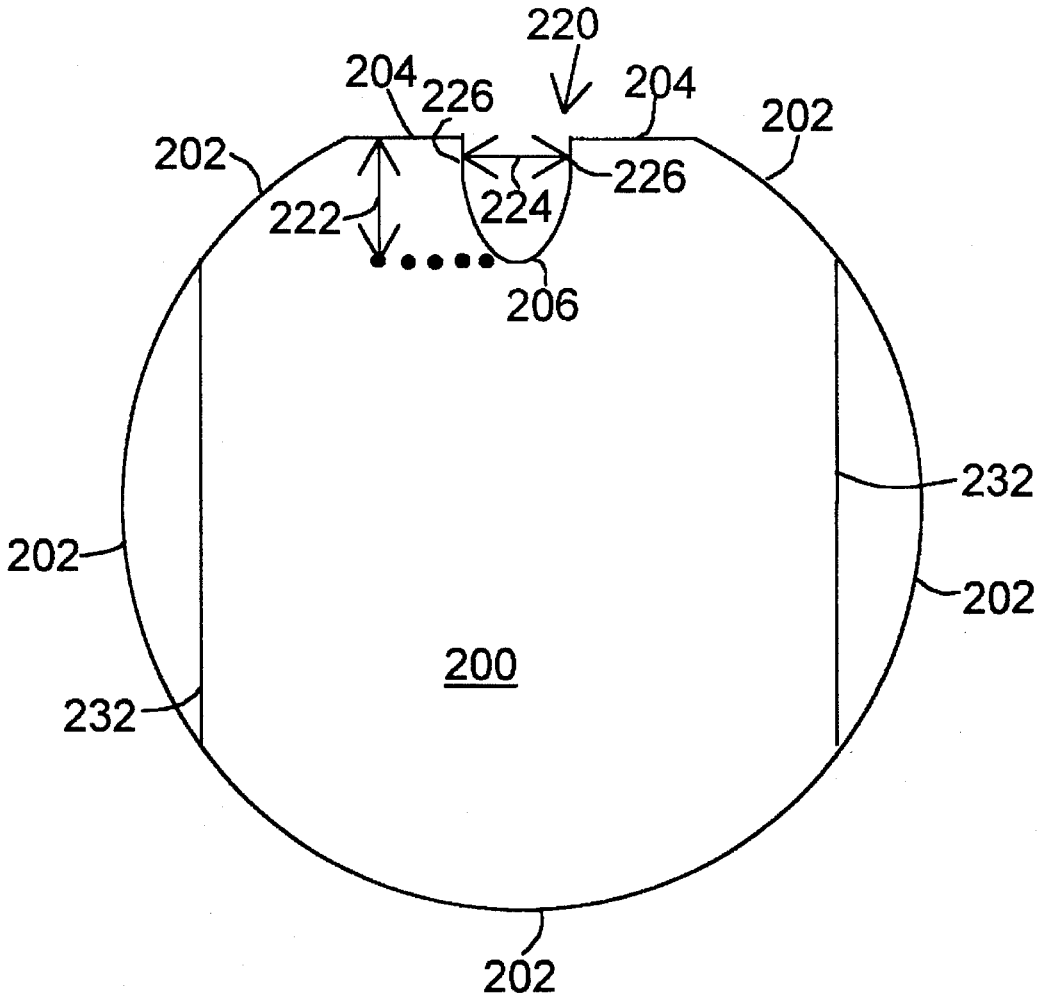
FIG. 5 shows an elevation view of the shaft as viewed along reference line 5—5 of FIG. 4.

A preferred embodiment of the grooved shaft is illustrated in FIG. 3, FIG. 4, and FIG. 5. In the preferred embodiment, the grooved shaft 126 has an axial groove 206. The axial groove 206 preferably has a groove cross section 220 with a semi-elliptical shape, a semi-circular shape, or a U-shape. Alternatively, the axial groove 206 may have a groove cross section with a rectangular shape, a trapezoidal shape, a V-shape, or the like. The groove cross section 220 has a groove depth 222 and a groove width 224 which may be varied according to the size of the particulate matter to be transmitted via the axial groove 206.

The grooved shaft 126 preferably has surface area contours including a flat area 205 and a cylindrical area 228, which result in the grooved shaft 126 having a shaft cross section 200 that is an irregular circle (i.e. eccentric) as best illustrated in FIG. 5. In other words, the shaft cross section 200 has a flat perimeter portion 204 and a circular perimeter portion 202. The flat area 205 surrounds the axial groove 206. The cylindrical area 228 bounds the flat area 205.

The flat area 205 is subdivided into a first flat region 208 and a second flat region 210. One side 226 of the groove 206 meets the first flat region 208 at a first boundary 212. Another side 226 of the groove 206 meets the second flat region 210 at a second boundary 214. The groove 206 optimally has sides 226 which are substantially perpendicular to the flat area 205. Removal means for removing particulate matter from the shaft-bearing interface comprise, for example, (a) sides 226 that are substantially radially extending with respect to the axis of the grooved shaft 126, or (b) sides 226 that are substantially orthogonal relative to the flat area 205.

The cylindrical area 228 adjoins the flat area 205 at a third boundary 216 and a fourth boundary 218. In particular, the cylindrical area 228 adjoins the first flat region 208 at the third boundary 216. The cylindrical area 228 adjoins the second flat region 210 at the fourth boundary 218. The third boundary 216 is gradually tapered with respect to the cylindrical area 228, and the circular perimeter portion 202. Likewise, the fourth boundary 218 is gradually tapered with respect to the cylindrical area 228, and the circular perimeter portion 202.

The third boundary 216 and the fourth boundary 218 have predetermined tolerances for surface roughness and all rough edges are broken, for example, at one hundredth (0.01) of an inch (tolerance 0.005 inch). The third boundary 216 and fourth boundary 218 are precisely finished, filed, ground, machined, or polished tangentially to the cylindrical area 228 and to the circular perimeter portion 202. The elimination of sharp edges at or near the third boundary 216 and the fourth boundary 218 is essential to prevent undue wear of the wearing surfaces of the shaft 126 and the bearing 124. Tapering of the surface area contours, and the shaft cross section 200, prevents wear if the radial loading force on the shaft shifts direction from one radial load force vector to another radial load force vector.

The grooved shaft 126 has a shaft cross section 200. The shaft cross section 200 may be divided into a first sector and a second sector, which conventionally comprise a total of 360 degrees. In a preferred embodiment, the first sector encompasses an arc of at least 350 degrees. The first sector of the cross section 200 defines an arc coincident with the circular perimeter portion 202. A second sector of the cross section 200 has an arc defined by the flat perimeter portion 204. An imaginary line drawn between the third boundary 216 and the fourth boundary 218 would bisect said arc. In other words, the flat area 205 has a width defined by the second sector.

In a preferred embodiment, the grooved shaft 126 has a front portion 201 with a front shaft radius 234 and a rear portion 203 with a rear shaft radius 236. The front shaft radius 234 is generally equal to or less than the rear shaft radius 236 so that the primary flow past the front portion 201 may be optimized. For example, reducing the front shaft radius 234 decreases flow resistance near the impeller eye or impeller intake. The front portion 201 and the rear portion 203 may be separated by a shoulder 237. The axial groove 206 optimally extends over the entire rear portion 203. In other embodiments, the axial groove may extend the entire length of the shaft or any length necessary (i.e. journal length) to create a channel for the internal circulation of pumped fluid within the centrifugal pump.

The rear portion 203 includes retaining surface means for retaining the shaft, such as a flat mating surface 232. Retaining surface means for retaining the shaft may include a corrugated surface, a flat mating surface, a mating indentation, a hexagonal surface, a rectangular surface, or the like. In alternate embodiments, retaining surface means for retaining the orientation of the shaft may comprise the combination of a coaxial tap in the shaft, a fastener, and an optional lock washer.

The grooved shaft 126 is preferably constructed from a ceramic, such as silicon carbide. The grooved shaft 126 may also be constructed from other ceramics including silicon carbide, silicon carbide type HIP (hot isostatic process), silicon carbide type SA (sintered-alpha), alumina, aluminum, bauxite, zirconia, zirconium, zironcia ceramics, or the like. Alternatively, the grooved shaft may be constructed from tungsten carbide, tungsten carbide and nickel, tungsten carbide and cobalt, stainless steel, forged aluminum, metal, or the like.

If silicon carbide is used, first, a binder or adhesive is added to the silicon carbide powder to improve adhesion between particles of the silicon carbide powder. Second, the grooved shaft is then molded by compacting or compressing silicon carbide powder. Third, the silicon carbide powder is heated and machined into a rough approximation of the final shape. In addition, the third step may, but need not, include roughly forming the groove. Fourth, the shaft is sintered at high temperature. Fifth, the groove is preferably machined in the grooved shaft. Once the shaft is sintered; final machining, polishing, and finishing can only be accomplished by using extremely hard tools, such as diamond files. Next, the flat area is preferably formed by grinding or machining the shaft. For instance, the third and fourth boundary are tapered by filing with a diamond file after sintering. Various ceramic shafts are commercially available from ESK Engineered Ceramics, Wacker Chemicals (U.S.A.), Inc., 535 Connecticut Ave., Norwalk, Conn. 06954.

The following illustrative example of a grooved shaft provides actual dimensions of a working model, which favorably circulated particulate matter having a maximum diameter of one thirty-second (1/32) of an inch: (a) The rear radius 236 is 1.25 inches with a minimum finish smoothness of 16 to 32 microinches average arithmetic roughness; (b) the groove depth 222 ranges from approximately 0.062 inch (tolerance 0.02 inch) to 0.086 inch (tolerance 0.02 inch); (b) the groove width 224 is approximately 0.125 inch as measured across the first boundary 212 and the second boundary 214. (The groove width at the bottom of the groove is less than the width at the top, measured across the first boundary and the second boundary, because of the preferred semi-elliptical or U-shaped groove cross section); (c) the flat perimeter portion 204 has a width of 0.220 inch (tolerance of 0.01 inch) and radially deviates below an "original" circular circumference a value ranging from a maximum of approximately 0.0157 inch to 0.0463 inch; preferably deviates below the "original" circular circumference by 0.024 inch; (d) the third boundary 216 and the fourth boundary 218 are tapered by hand finishing so that the finish of the rear radius 236, near the third boundary 216 and the fourth boundary 218 varies, by no more than 0.01 inch per degree of rotation about the pump shaft's axis; and (e) various sharp edges at the intersection of the cylindrical area 228 and the ends of the grooved shaft 126 are preferably chamfered or beveled at 45 degree angles as best illustrated in FIG. 4.

The bearing 124 comprises a sleeve-type bearing with a cylindrical hollow 242. The grooved shaft 126 coaxially mates with the cylindrical hollow 242 of the bearing 124. The bearing 124 has a sleeve 238 coaxially oriented within a bearing body 246, which may be constructed from a plastic resin such as polytetrafluoro-ethylene, ethylene-tetra-fluoro ethlene, carbon fiber filled polytetrafluoro-ethylene, carbon fiber filled ethylene-tetra-fluoro ethlene, or the like. The sleeve 238 is preferably constructed from silicon carbide, stainless steel, carbon, a metal, a ceramic, or the like. The sleeve 238 provides an appropriate product-lubricated wearing surface 244 for the grooved shaft 126. In practice, the bearing 124 may have a plurality of longitudinally spaced sleeves along the axis of the cylindrical hollow 242. A typical and acceptable clearance between the inner diameter of the sleeve 238 and the outer diameter of the grooved shaft 126 is three thousandths (0.003) of an inch.

Centrifugal Pump

Figure 6:
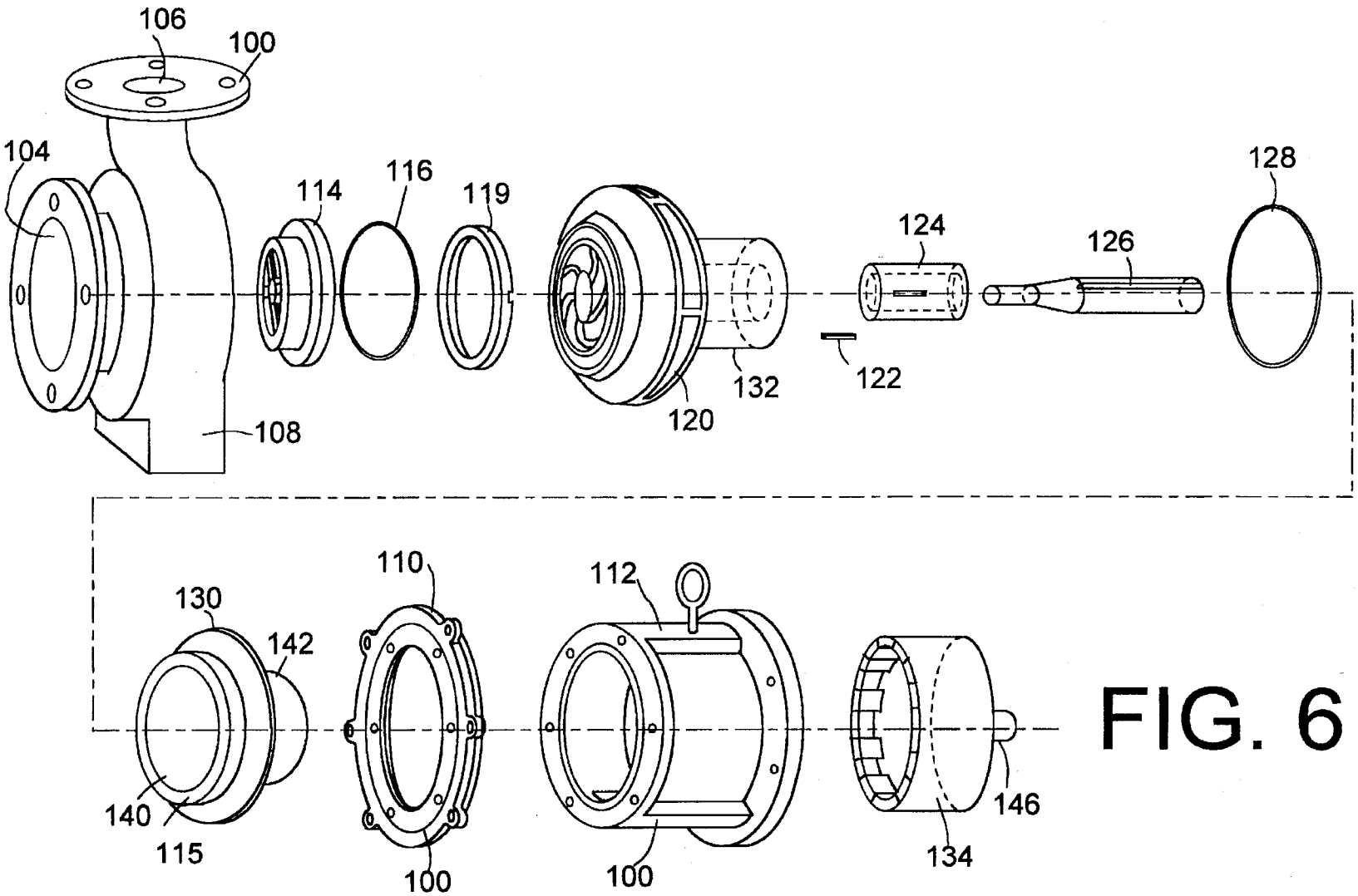
FIG. 6 shows an exploded perspective view of a magnetic-drive centrifugal pump incorporating the grooved shaft.
Figure 7:
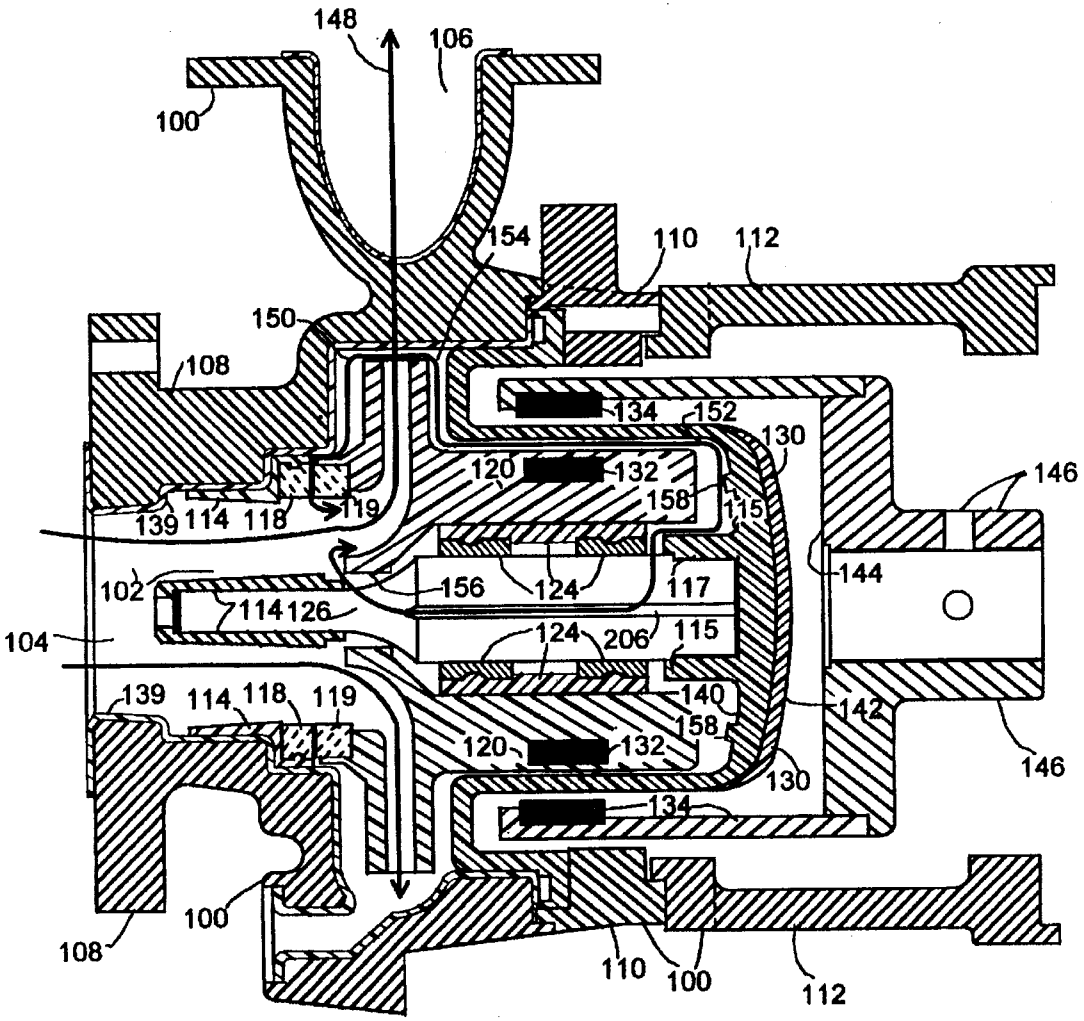
FIG. 7 shows a cross-sectional view of the pump in FIG. 6 along with primary and secondary fluid flow paths.

Referring to FIG. 6 and FIG. 7, the centrifugal pump of the present invention comprises a housing 100, a grooved shaft 126, a first shaft support 114, a second shaft support 115, a bearing 124, an impeller 120, a first coupler 132, a second coupler 134, and a containment shell 130.

In a preferred embodiment the housing 100 includes a first housing member 108, a second housing member 110, and a third housing member 112. Alternatively, the housing 100 may integrate the second housing member 110 and the third housing member 112 into a single housing member. The first housing member 108 and the second housing member 110 mate with a second gasket 128 (i.e. an O-ring). The containment shell 130 adjoins the first housing member 108 and the second housing member 110. The second housing member 110 is secured to the first housing member 108. The third housing member 112 is secured to the first housing member 108 or the second housing member 110, or both the first housing member 108 and the second housing member 110.

The housing 100 has an inlet 104 to receive a fluid and an outlet 106 to emit the pumped fluid. The housing 100 has an inlet flange and an outlet flange for the attachment of external plumbing to the pump. The inlet flange and outlet flange have a plurality of holes to facilitate the attachment of external plumbing. The housing may be constructed from cast iron, stainless steel, alloys, or other metals. The interior fluid-contacting surfaces of the housing 100 are preferably coated with a corrosion-resistant lining 139.

The grooved shaft 126 is disposed in the housing 100 and is preferably secured to the housing 100. The grooved shaft 126 is secured to the housing 100 by a support assembly that preferably includes a first shaft support 114 and a second shaft support 115. For instance, the first shaft support 114 may be located near the impeller 120 and the second shaft support 115 may be located adjacent to or integral with the containment shell 130. As illustrated, the first shaft support 114 and the second shaft support 115 each annularly surround the grooved shaft 126.

The first support 114 and the second support 115 each have a recess or a socket, which corresponds to and complementarily mates with the grooved shaft 126. For example, the second shaft support 115 may include a socket 117 to mate with the flat mating surface 232 or retaining surface means. The engagement of the retaining surface means and the socket 117 prevents undesired rotation of the grooved shaft 126. The grooved shaft 126 may be secured by press fitting the flat mating surface 232 of the grooved shaft 126 into the socket 117 of the second shaft support 115. The second shaft support 115 may be integrated with the containment shell 130 or may be integrated with the second housing member 110. The second support 115 preferably has ribs 158 located adjacent to the rear of the impeller 120. The ribs 158 reduce swirling fluid behind the impeller 120 and increase the volume of fluid traveling through a bushing flow path 152. Consequently, build up of particulate matter near the second shaft support 115 or the containment shell 130 is reduced. A radial extending fastener, relative to the axis of the grooved shaft 126, may be used to secure the grooved shaft 126 to the first shaft support 114 or the second shaft support 115. The first shaft support 114 and the second shaft support 115 are preferably constructed of plastic resin with carbon fiber content ranging from ten percent to thirty percent by weight; optimally twenty percent.

A thrust ring 118 and a first gasket 116 are located between the impeller 120 and the first shaft support 114. The impeller 120 has a mouth ring 119 which adjoins the thrust ring 118. The grooved shaft 126 has an axial groove 206 and is coaxially surrounded by a bearing 124. The axial groove 206 forms a channel for the circulation of pumped fluid about the wearing surfaces of the grooved shaft 126 and the bearing 124. In addition, the axial groove 206 forms a channel for the removal of particulate matter from the space between the grooved shaft 126 and the bearing 124.

The bearing 124 is attached to an impeller 120. A key 122 fits in a slot 240 located in the bearing 124 and the impeller 120 to prevent the impeller 120 from rotating with respect to the bearing 124. In a preferred embodiment, the impeller 120 is constructed from a carbon filled plastic resin, such as a mixture of polyacrylonitrile (PAN) carbon fiber and ethylene-tetra-fluoro-ethlene (ETFE). The mixture preferably contains approximately twenty percent carbon fiber by weight and optimally uses one-quarter inch strands of carbon fiber.

The impeller 120 has a cylindrical portion which optimally encapsulates the first coupler 132. The impeller 120 is coupled to the first coupler 132. The first coupler 132 comprises a magnet, a rare-earth magnet, a plurality of magnets, or a torque ring. A torque ring is typically constructed from a metal such as steel, copper, an alloy, or the like. As illustrated the impeller 120 is a fully closed impeller, in which the vanes are concealed by a back shroud and a front cover. In practice, the impeller 120 may be partially open impeller, or a fully open impeller depending upon the characteristics of the fluid to be pumped. The first coupler 132 is enclosed by the containment shell 130 and the housing 100. The first coupler 132 is located on a first side 140 of the containment shell 130.

The second coupler 134 is located in proximity to the first coupler 132 on a second side 142 of the containment shell 130. The second coupler 134 has a cylindrical cavity 144 which is coaxially oriented with respect to the containment shell 130. The second coupler 134 comprises a magnet, a rare-earth magnet, a plurality of magnets, an electromagnet, a plurality of electromagnets, or a torque ring. The second coupler 134 is coupled to a drive motor (not shown).

The containment shell 130 is secured to the housing 100. The containment shell 130 is preferably constructed from a nonconductive material, such as ethylene-tetra-fluoro-ethlene (ETFE), or a fiber fabric vinyl ester composite. The containment shell 130 may also be made from stainless steel, nickel, cadmium, a metal, an alloy, or the like. The containment shell 130 confines the pumped fluid to the first side 140 of the containment shell 130.

Flow Paths in the Centrifugal Pump

Referring to FIG. 7 the flow paths within the pump interior include a primary flow path 148 and a secondary flow path (i.e. internal circulation flow path). The primary flow path 148 originates at the inlet 104 and continues to the outlet 106. The primary flow path 148 may also confluence with the secondary flow path at the impeller intake. In contrast, the secondary flow path originates at a beginning point 154 near the periphery of the impeller 120. The secondary flow path includes the bushing flow path 152 and the thrust ring flow path 150.

The bushing flow path 152 extends from the beginning point 154 around the impeller 120 and through the space between the bearing 124 and the grooved shaft 126. The bushing flow path 152 includes fluid, as well as particulate matter, traveling axially down the channel formed by the axial groove 206. The bushing flow path 152 ends at a terminal point 156 near the impeller intake. The fluid of the bushing flow path 152 is sucked from the space between the bearing 124 and the grooved shaft 126 through a gap between the impeller 120 and the first shaft support 114. The secondary flow path then converges with the primary flow path 148 at the impeller intake and is mostly carried out the outlet 106. Therefore, particulate matter in the fluid of the secondary flow path is expelled from the outlet 106 after converging with the primary flow path 148.

Figure 8:
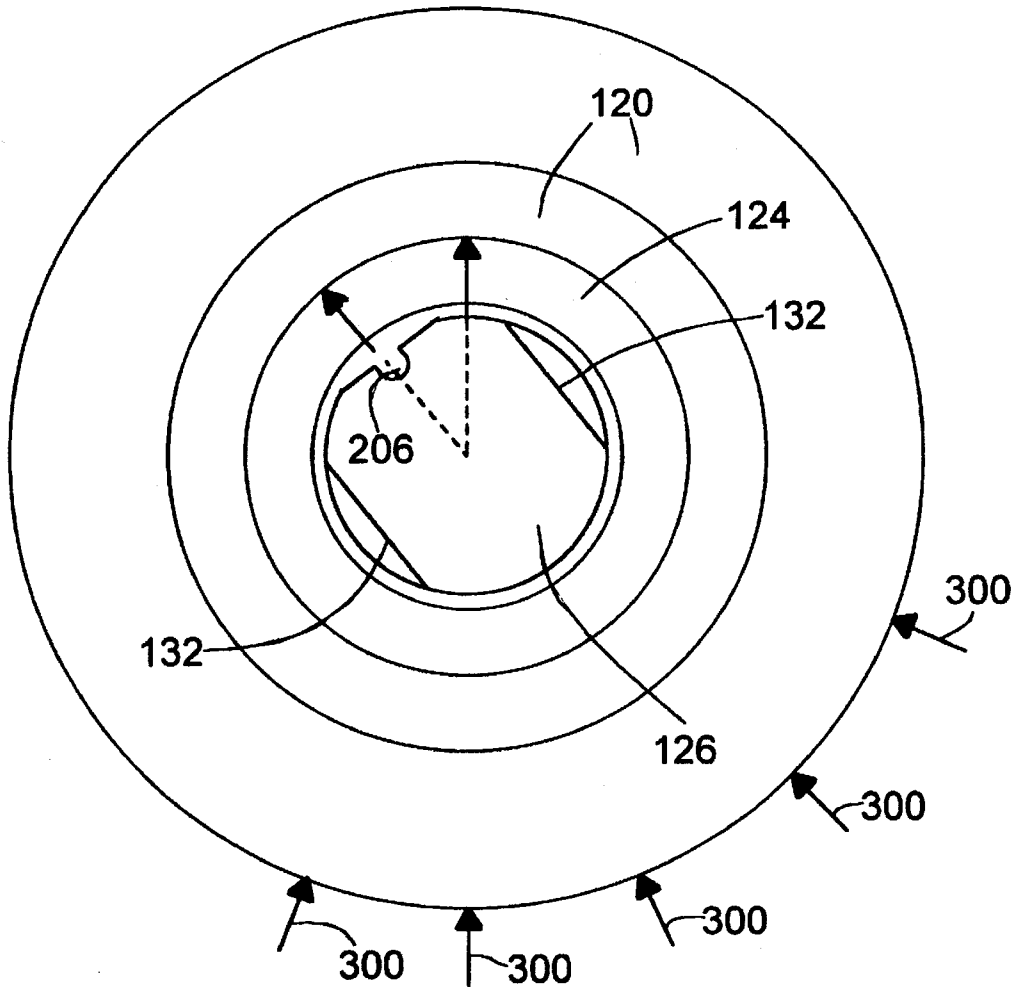
FIG. 8 shows an elevation view of the shaft, as viewed from the drive end of the centrifugal pump; specifically.

The grooved shaft 126 is optimally stationary relative the housing of the centrifugal pump in which the grooved shaft is incorporated. FIG. 8 illustrates an example of proper orientation of the axial groove 206 in the stationary grooved shaft with respect to the radial loading or radial loading force vectors 300. Generally, the axial groove 206 should be oriented in any direction in which minimal radial loading occurs. In particular, the axial groove 206 is optimally positioned directly opposite from the radial load force vectors 300 as illustrated in FIG. 8. In FIG. 8, for example, minimal loading occurs over the recommended operating pump operating conditions when the axial groove of the shaft is fixed at approximately the eleven o'clock position. If the axial groove 206 is oriented for minimal radial loading, then the shaft-bearing interface may operate in the hydrodynamic fluid film regime, which theoretically eradicates wear of the shaft-bearing interface.

Radial loading is caused by unbalanced pressures in the casing or the volute. The magnitude and the direction of radial loading force vectors vary with pump's operating point (i.e. a specified flow rate and head) and the specific gravity of the fluid. Radial loading may be influenced by the balancing of the impeller, the density variations in the fluid being pumped, and the combined geometry of the impeller and casing interior.

Because radial loading may change, specifying a range of positions yielding minimal loading on the axial groove 206 is desirable. For example, a range of positions for the axial groove 206 that yields minimal loading may lie generally within a range from ten o'clock to two o'clock.

The shaft and the axial groove 206 are stationary with respect to the housing of the centrifugal pump. The properly positioned axial groove 206 is not compressed against the bearing by an alignment with the radial load force vectors 300 as a result of the rotation of the bearing about the shaft. Therefore, the shaft-bearing interface may operate in the hydrodynamic lubrication regime with minimal shaft wear and frictional heating once the groove is oriented for minimal radial loading as previously described.

Using the Centrifugal Pump to Pump Fluids Containing Particulate Matter

The centrifugal pump incorporating the grooved shaft can tolerate particulate matter of a diameter that exceeds the clearance between the bearing and the shaft surfaces. For instance, the grooved shaft may provide a channel for particulate matter occupying two thousands of an inch if the clearance between the shaft journal and the bearing is approximately two thousands of an inch. The maximum predetermined size of the particulate matter than the groove can successfully pass to the outlet cannot exceed the size of the groove cross section.

The centrifugal pump incorporating the grooved shaft may, for example, effectively tolerate less than one-half percent particulate matter content by total pumped fluid volume over the entire range of recommended pump capacity. If a pump is operated at its best efficiency point (i.e. optimum head and flow rate), then the pump may, for example, tolerate up to three percent particulate matter content by pumped volume. However, if the fluid merely contains soluble caustic soda flakes, the pump can tolerate higher percentages of particulate matter than previously specified.

Alternate Embodiments of a Grooved Shaft

Figure 9:
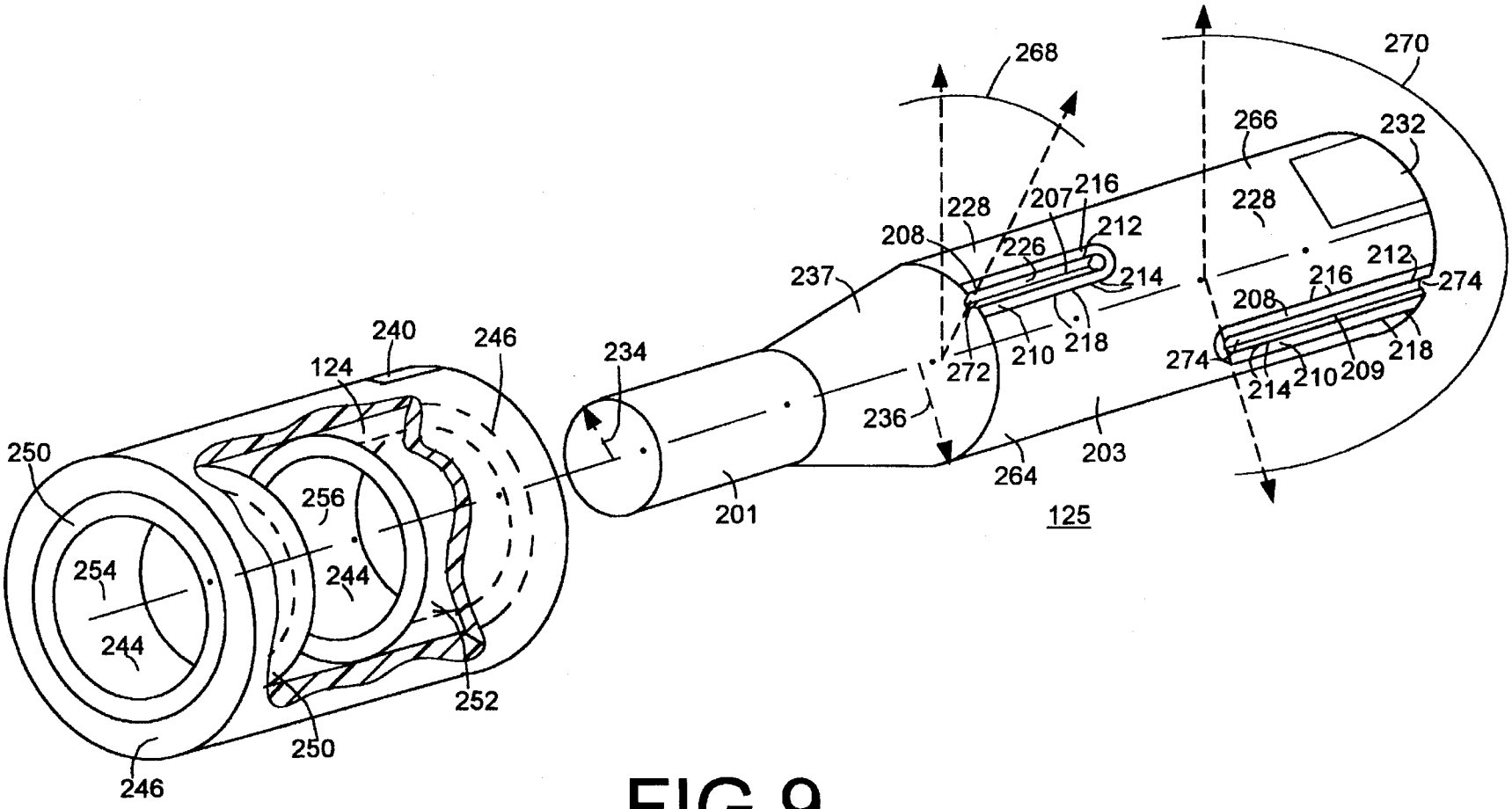
FIG. 9 illustrates an exploded perspective view of an alternate embodiment the grooved shaft and the bearing with the bearing body partially cutaway to reveal the first bushing and the second bushing.
Figure 10:
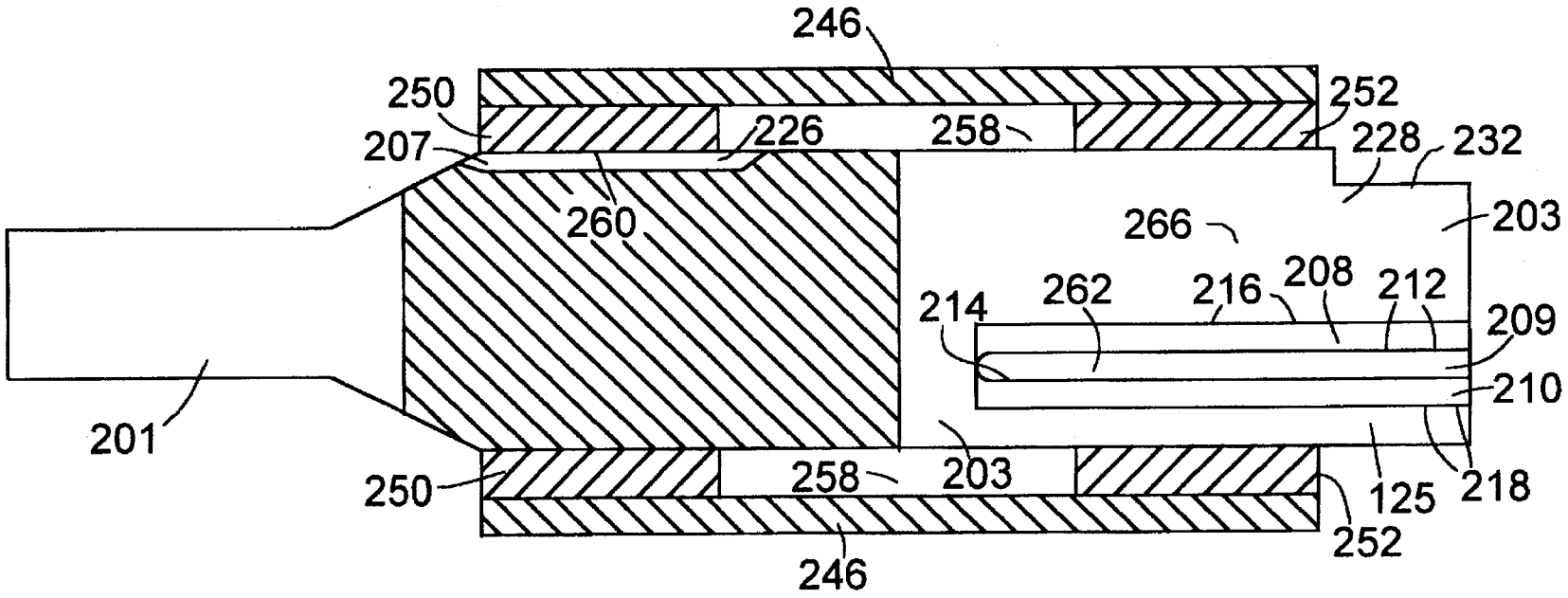
FIG. 10 illustrates a cross-sectional view of the alternate embodiment of the grooved shaft and the bearing shown in FIG. 9.

An alternate shaft 125 in conjunction with a bearing 124 is illustrated in FIG. 9 and FIG. 10. The alternate shaft 125 has a first groove 207 and a second groove 209. The first groove 207 and the second groove 209 both have similar features to the axial groove 206 of FIG. 3. Like features are labeled accordingly throughout FIG. 3, FIG. 9, and FIG. 10.

The bearing 124 has a bearing body 246 that retains a first bushing 250 and a second bushing 252. The first bushing 250 and the second bushing 252 are oriented coaxially within the bearing body 246. The first bushing 250 is axially separated from second bushing 252 along an axis of the bearing body 246. A bearing cavity 258 intervenes between the first bushing 250 and the second bushing 252. The first bushing 250 has a first cylindrical hollow 254. The second bushing 252 has a second cylindrical hollow 256.

The radial loading forces that the first bushing 250 and the second bushing 252 apply to the shaft 125 may differ. The first groove 207 and the second groove 209 may be independently oriented to compensate for different radial loading force vectors. The shaft cross section of shaft 125 generally has a substantially circular outline capable of division into sectors, such as an alpha sector and a beta sector. The alpha sector and the beta sector include the alpha angle 268 and the beta angle 270, respectively.

The alpha sector is selected to provide minimal radial loading vector forces on the first groove 207. Similarly, the beta sector is selected to provide minimal radial loading vector forces on the second groove 209. The first groove 207 has a first groove cross section 272 oriented within an alpha sector at an alpha angle 268. An imaginary pair of arrows and an imaginary arc defines the alpha angle 268 in FIG. 9. The second groove 209 has a second groove cross section 274 oriented within a beta sector at a beta angle 270. An imaginary pair of arrows and an imaginary arc defines the beta angle 270.

The shaft 125 has a first journal area 264 and a second journal area 266. The first journal area 264 is associated with a first bushing 250. The first journal area 264 is defined by the surface area of the first cylindrical hollow 254. The second journal area 266 is associated with the second bushing 252. The second journal area 266 is defined by the surface area of the second cylindrical hollow 256.

The respective first groove 207 is associated with the corresponding first bushing 250. The respective second groove 209 is associated with the corresponding second bushing 252. The first groove 207 has a first groove length 260, which spans an axial dimension of the first journal area 264. The first groove length 260 preferably extends slightly beyond the first journal area 264 to provide a reliable hydraulic channel. The second groove 209 has a second groove length 262, which spans an axial dimension of the second journal area 266. The second groove length 262 preferably extends slightly beyond the second journal area 266 of the shaft 125 to provide a reliable hydraulic channel.

The alpha sector is, for example, determined by the radial loading forces applied to the first journal area 264 during actual centrifugal pump operating conditions or under test conditions. The beta sector is, for example, determined by the radial loading forces applied to the second journal area 266 during actual centrifugal pump operating conditions or under test conditions. Alternatively, calculations of loading may be completed to determine the desired alpha sector orientation and desired the beta sector orientation. If consistent manufacturing processes of a particular centrifugal pump are used, the calculated values or tested values for the alpha sector and the beta sector may be universally applied to produce a uniform shaft for the particular centrifugal pump.

Referring to FIG. 10, if the alternate shaft 125 were installed in a pump, then the pumped fluid would first travel through the second groove to the bearing cavity from the pressure side of the impeller, then the pumped fluid would travel through the first groove to the suction side of the impeller.

Figure 11:
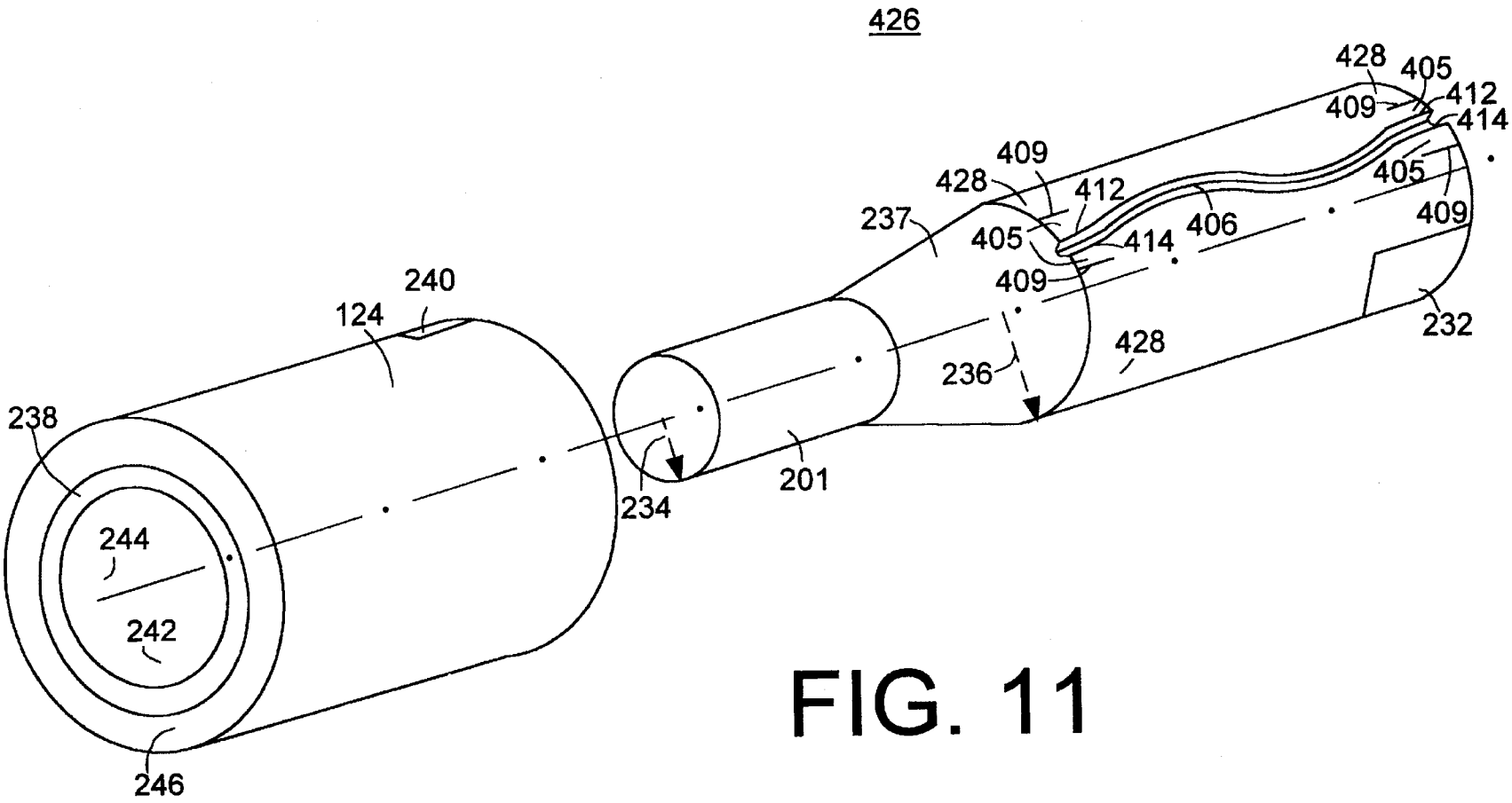
FIG. 11 illustrates an alternate embodiment of the grooved shaft, which has a curved groove.

FIG. 11 illustrates another embodiment of the grooved shaft 426. FIG. 11 emphasizes the cross-sectional elements of the grooved shaft 426 near the ends of a curved groove 406. The curved groove 406 follows a curved path circuitously and primarily longitudinally along the grooved shaft 426. The curved groove 406 adjoins a flat perimeter portion 405 (when a single, cross-sectional plane of the shaft is considered) or a flat area (when the shaft is considered in three dimensions). The flat area is defined by a plurality of adjacent flat perimeter portions 405 that adjoin the curved groove 406. The shaft 426 has a substantially circular perimeter portion 428 (when a single, cross-sectional plane of the shaft is considered) or a substantially cylindrical area (when the shaft is considered in three dimensions). The cylindrical area is defined by a plurality of adjacent circular perimeter portions 428. The axial groove 406 meets the flat perimeter portion 405 or the flat area at a first boundary 412 and at a second boundary 414. The boundaries 409 where the flat perimeter portion 405 meets the circular perimeter portion 428 are defined as described in other embodiments in this specification as the third boundary and the fourth boundary. The groove may follow a curved or helical path circuitously about the shaft. However, a helical shaft is susceptible to a stress fracture occurring at a point where a notch (i.e. groove) is partially or completely radially oriented with respect to the shaft. In contrast, an axial shaft is tolerant to stress from bending forces that are axially or longitudinally applied to the shaft. Therefore, an axial groove is a preferred form of the present invention because an axial groove produces minimal weakening of the shaft.

Alternate Embodiment of a Centrifugal Pump

Figure 12:
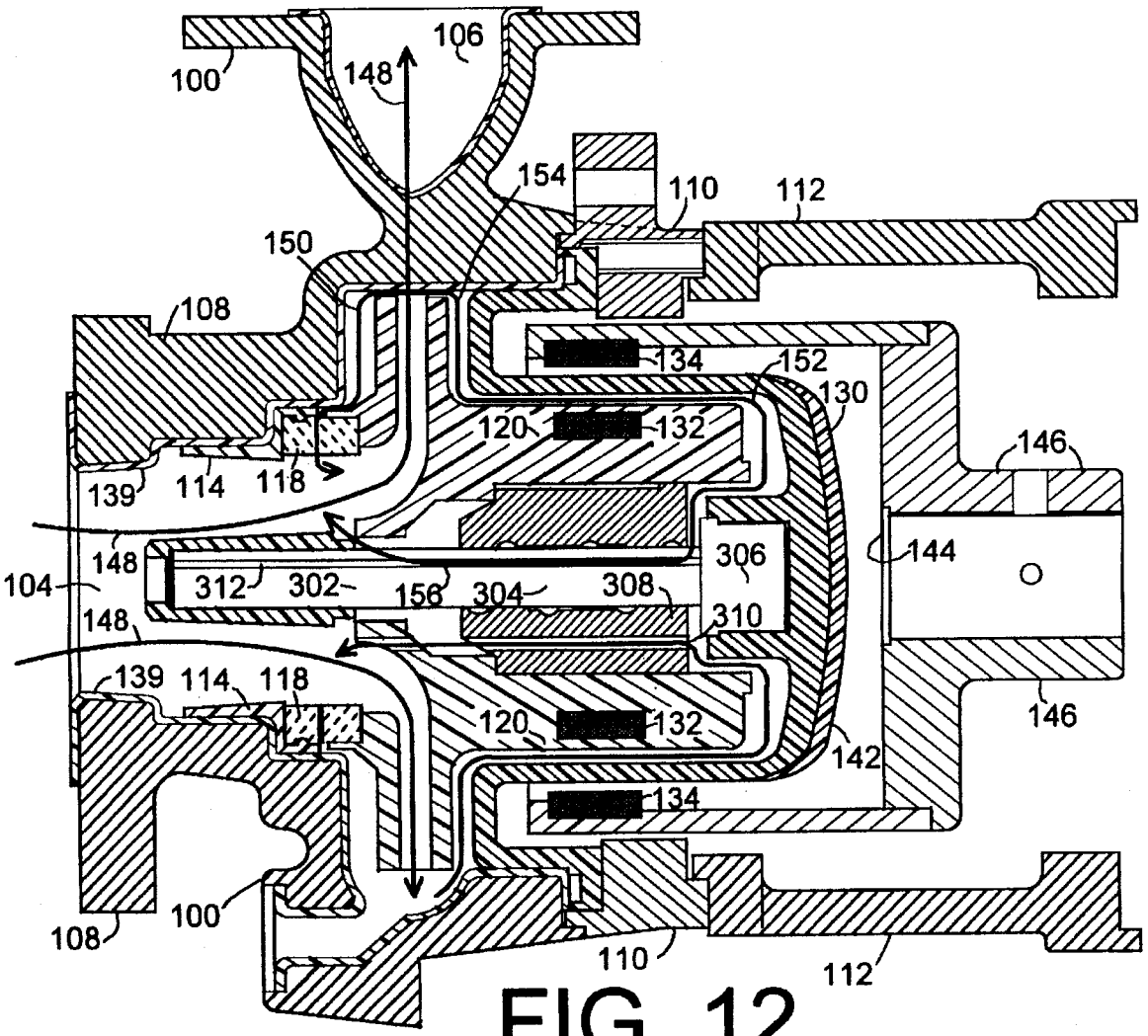
FIG. 12 illustrates an alternate embodiment of the magnetic-drive pump wherein the grooved shaft is substantially cylindrical and wherein the bushing has a bypass channel.

An alternate embodiment of a centrifugal pump incorporating a notched shaft 302 with an axial notch or groove is illustrated in FIG. 11. The notched shaft 302 of FIG. 12 has a substantially uniform radius with the exception of the regions where the axial notch 312 and a mating head 306 are disposed. In addition, the bushing 308 of FIG. 9 has an axial bypass channel 310. In other respects, the centrifugal pump of FIG. 12 is substantially similar, but not identical, to the centrifugal pump of FIG. 3 and FIG. 4. Accordingly, like elements are labeled consistently throughout FIG. 3, FIG. 4 and FIG. 12.

The foregoing description is provided in sufficient detail to enable one of ordinary skill in the art to make and use the grooved shaft and the centrifugal pump incorporating the grooved shaft. The foregoing detailed description is merely illustrative of several physical embodiments of the grooved shaft and the centrifugal pump. Physical variations of the grooved shaft and the centrifugal pump incorporating the grooved shaft, not fully described in the specification, are encompassed within the purview of the claims. For example, the axial groove may be curved, rather than linear. Accordingly, the narrow description of the elements in the specification should be used for general guidance rather than to unduly restrict the broader descriptions of the elements in the following claims.

We claim:

1. A shaft for use in a magnetic-drive centrifugal pump, the improvement comprising:

an axial groove disposed in the shaft, the axial groove having a groove cross section and sides; and a shaft cross section of the shaft having a substantially flat perimeter portion and a substantially circular perimeter portion; the axial groove adjoining the flat perimeter portion at a first boundary and at a second boundary.

2. The shaft according to claim 1 wherein said sides orthogonally meet the flat perimeter portion at the first boundary and orthogonally meet the flat perimeter portion at the second boundary.

3. The shaft according to claim 1 wherein the shaft includes a journal area; wherein the axial groove follows a substantially linear path paralleling an axis of the shaft; and wherein a length of the linear path spans an axial dimension of the journal area of said shaft.

4. The shaft according to claim 1 wherein the axial groove follows a curved path circuitously extending longitudinally along the shaft.

5. The shaft according to claim 1 wherein the flat perimeter portion bounds the substantially circular perimeter portion at a third boundary and a fourth boundary; the third boundary and the fourth boundary being tapered to form gradual transitions between the circular perimeter portion and the flat perimeter portion, a shaft radius varying a predetermined maximum amount at the third boundary and the fourth boundary.

6. The shaft according to claim 1 wherein the groove cross section has a shape selected from the group consisting of a U-shape, a V-shape, a semi-ellipse, a rectangle, and a semi-circle.

7. The shaft according to claim 1 wherein the shaft has a front portion having a front shaft radius and a rear portion having a rear shaft radius, and wherein the front shaft radius is smaller than the rear shaft radius.

8. The shaft according to claim 7 wherein the axial groove extends across the rear portion.

9. The shaft according to claim 1 further comprising retaining surface means for retaining the orientation of the shaft.

10. The shaft according to claim 9 wherein the retaining surface means comprise at least one substantially flat mating surface.

11. The shaft of claim 1 wherein the shaft is constructed from a ceramic selected from the group consisting of silicon carbide, silicon carbide type HIP, silicon carbide type SA, tungsten carbide, alumina, bauxite, and zirconia.

12. The shaft according to claim 1 wherein the circular perimeter portion defines an outline of a cylindrical area, the flat perimeter portion defines a profile of a flat area; and wherein the shaft further comprises ends and chamfered edges; the cylindrical area adjoining the flat area, the chamfered edges located at junctions of the cylindrical area and the ends.

13. A centrifugal pump comprising:

a housing having a housing cavity, an inlet and an outlet;

a shaft having an axial groove and a journal area, the shaft having a cross section defined by a substantially circular perimeter portion and a substantially flat perimeter portion, the substantially flat perimeter portion defining a contour of a substantially flat surface area of the shaft, the substantially flat surface area approximately bordering the axial groove for a majority of a length of the axial groove;

a support assembly affixing said shaft to said housing;

a bearing coaxially surrounding the journal area of the shaft and rotatable with respect to said shaft; and an impeller coupled to said bearing.

14. The centrifugal pump of claim 13 wherein the substantially circular perimeter portion, the axial groove, and the substantially flat perimeter portion comprise a total sector of 360 degrees of said cross section; and wherein the circular perimeter portion defines a first sector of at least 350 degrees.

15. The centrifugal pump of claim 13 wherein the flat surface area includes a first flat region and a second flat region; the first flat region adjacently oriented to a first boundary of said groove and the second flat region adjacently oriented to a second boundary of said groove.

16. The centrifugal pump of claim 13 wherein the axial groove includes a groove cross section, the groove cross section having a shape selected from the group consisting of a U-shape, a V-shape, a rectangle, a semi-ellipse, and a semi-circle.

17. The centrifugal pump of claim 13 wherein the axial groove includes a groove cross section having a groove width and a groove height selected to axially pass particulate matter of a predetermined size.

18. The centrifugal pump of claim 13 wherein the shaft includes a substantially cylindrical area associated with the circular perimeter portion; and wherein the axial groove in the shaft has sides, one of said sides being approximately perpendicular to the substantially cylindrical area.

19. The centrifugal pump of claim 13 wherein the axial groove in the shaft has sides, and wherein each of said sides is approximately perpendicular to the substantially flat surface area.

20. The centrifugal pump of claim 13 wherein the substantially flat surface area adjoins the axial groove at a first boundary and at a second boundary, and wherein sides of the axial groove are substantially orthogonal to the flat surface area at the first boundary and the second boundary.

21. The centrifugal pump of claim 13 wherein the shaft is held stationary by the support assembly; and wherein the groove is oriented in an operating position having a minimal radial force load applied from said bearing to said shaft.

22. The centrifugal pump of claim 21 wherein the operating position comprises the groove being oriented between a ten o'clock position and a two o'clock position when viewing the shaft from a drive end of said shaft, the ten o'clock position and the two o'clock position being measured relative to a twelve o'clock position in which the outlet extends.

23. The centrifugal pump of claim 13 wherein the centrifugal pump has at least one internal circulation channel allowing the flow of pumped fluid from the housing cavity to be circulated through a space between the axial groove and the bearing; and wherein the support assembly has ribs to direct the pumped fluid in the internal circulation channel toward the axial groove and the bearing.

24. The centrifugal pump of claim 23 further comprising a thrust ring disposed adjacent to the impeller, a gap being associated with the thrust ring, a portion of the internal circulation channel being formed by the gap.

25. The centrifugal pump according to claim 13 wherein the shaft is constructed from a material selected from the group consisting of silicon carbide, tungsten carbide, steel, stainless steel, and a ceramic composition.

26. The centrifugal pump according to claim 13 wherein the support assembly has a first shaft support located in the housing cavity and a second shaft support, and wherein the second shaft support has a respective socket for receiving a corresponding flat mating surface of said shaft such that the shaft is stationary.

27. The centrifugal pump of claim 13 further comprising a nonmetallic containment shell attached to said housing and sealing the housing cavity.

28. A centrifugal pump comprising:

a housing having a housing cavity, an inlet and an outlet;

a shaft having an axial groove and a journal area, the axial groove being bounded by a substantially flat area at a first boundary and a second boundary, the substantially flat area adjoining a cylindrical area of the shaft at a third boundary and at a fourth boundary, the third boundary and the fourth boundary being tapered to a finish of predetermined roughness with respect to the cylindrical area;

a support assembly affixing said shaft to said housing;

a bearing coaxially surrounding the journal area of the shaft and rotatable with respect to said shaft; and an impeller coupled to said bearing.

29. A magnetic-drive centrifugal pump wherein the improvement comprises:

a pump shaft having an axial groove, a flat area, and a cylindrical area, the flat area surrounding the axial groove, the cylindrical area adjoining the flat area.

30. The magnetic-drive centrifugal pump according to claim 29 wherein the improvement further comprises:

a first boundary and a second boundary defined by the intersection of the flat area with the axial groove, said intersection being approximately orthogonal;

a third boundary and a fourth boundary adjoining the substantially cylindrical area; the third boundary and the fourth boundary defining regions that extend tangentially between the cylindrical area and the flat area.

31. The magnetic-drive centrifugal pump according to claim 29 wherein the magnetic-drive centrifugal pump includes a housing and a bearing; the shaft being substantially stationary with respect to the housing, and the bearing being rotatable with respect to the shaft.

32. The magnetic-drive centrifugal pump according to claim 29 wherein one end of the shaft has a mating indentation for securing said shaft to a containment shell.

33. The magnetic-drive centrifugal pump according to claim 29 wherein the shaft has a front shaft radius and a rear shaft radius; wherein the front shaft radius is less than the rear shaft radius; and wherein the front shaft radius is located adjacently to the eye of an impeller.

34. The magnetic-drive centrifugal pump according to claim 29 wherein a bearing has a bearing body constructed from a plastic resin and wherein the bearing has a cylindrical sleeve, the cylindrical sleeve coaxially oriented within the bearing body.

35. The magnetic-drive centrifugal pump according to claim 34 wherein the impeller is coupled to the bearing, and wherein the impeller contains a first magnetic coupler, the impeller constructed from a plastic resin selected from the group consisting of polytetrafluoro-ethylene, carbon fiber filled polytetrafluoro-ethylene, carbon fiber filled ethylene-tetra-fluoro-ethlene, ethylene-tetra-fluoro-ethlene, and a fluoropolymer.

* * * * *